United States Patent [19]

Pike

[11] 3,983,609

[45] Oct. 5, 1976

[54] AIR ENTANGLEMENT OF YARN

[75] Inventor: Herbert J. Pike, Martinsville, N.J.

[73] Assignee: J. P. Stevens & Co., Inc., New York, N.Y.

[22] Filed: Aug. 25, 1975

[21] Appl. No.: 607,129

[52] U.S. Cl. ..... 28/1.4
[51] Int. Cl.[2] ..... D02G 1/16
[58] Field of Search ..... 28/1.4, 72.12

[56] References Cited

UNITED STATES PATENTS

| | | | |
|---|---|---|---|
| 3,302,386 | 2/1967 | Gonsalves et al. | 28/72.12 X |
| 3,325,872 | 6/1967 | Ethridge et al. | 28/1.4 |

FOREIGN PATENTS OR APPLICATIONS

| | | | |
|---|---|---|---|
| 233,939 | 6/1961 | Australia | 28/72.12 |

*Primary Examiner*—Louis K. Rimrodt
*Attorney, Agent, or Firm*—Robert Ames Norton; Michael T. Frimer; Saul Leitner

[57] ABSTRACT

Yarn is treated in an air entangling apparatus having a yarn introducing guide tube through which one or more yarns are fed, a central bore positioned so that the yarn guiding tube enters it at an angle, and an air jet blowing into the central bore substantially at right angles to the axis thereof. The central bore extends through the texturizing block, and the air jet causes air to leave at both ends of the bore. The yarn continues through the bore, leaving at the downstream end. Overfeed of the yarn is kept at a fairly low point, from a fraction of a percent to a maximum of about 10% and the air pressure is also moderately low, preferably from about 6 psig to 12 psig. At least one of the yarns used is a multifilament yarn and treatment with the present apparatus entangles or interlaces the filaments. If two or more yarns are employed, the product is a plied yarn.

7 Claims, 2 Drawing Figures

AIR ENTANGLEMENT OF YARN

BACKGROUND OF THE INVENTION

A number of apparatuses for treating multifilament yarn with air jets were known in the past, some providing cocurrent movement of air blasts and yarn. In many of the apparatuses, the air entering is introduced into a chamber or bore at an angle to the travel of yarn in a path that intersects the axis of the bore and this air jet results in fluttering or oscillation of the yarn. In others, the air introduction into the chamber or bore is tangential so that the air column whirls around the chamber or bore and imparts twist to the yarn.

A typical example of the first class is represented by the patent to London, U.S. Pat. No. 3,824,776. In this patent one or more multifilament yarns are pretexturized and then passed through a bore of an air jet apparatus in a straight path which follows the axis of the bore. Air at relatively high pressure is introduced into the bore at an angle of 45°–75° with the air flow in the bore being cocurrent with the yarn direction. The patent describes only the use of pretexturized yarn and produces non-uniform, intermittent entanglement with nodal points between portions which are fluffed out. The non-uniform entanglement apparently somewhat resembles tiny sausage links or beads.

Another patent belonging to the same group is the Palm U.S. Pat. No. 2,942,402, June 28, 1960. One of the critical features of the invention is that there is a significant amount of leakage of air back through the yarn guide even though this is filled to a considerable extent by yarn. In Palm the yarn is fed to the bore with substantial overfeed and moves through the bore along a path which follows the axis of the bore. The product produced by Palm is voluminous and contains loops of individual filaments which project from the main body of the yarn.

The second class of air jet apparatuses, in which air is introduced tangentially, includes my earlier U.S. Pat. Nos. 3,653,196, Apr. 4, 1972; 3,700,391, Oct. 24, 1972; and 3,831,363, Aug. 27, 1974. In each of my three patents the whirling air stream causes the yarn which is introduced to spin in the form of one or more loops similar in appearance to a jumping rope. This introduces a large amount of false twist and the false twist is allowed to untwist with an abrupt change in direction, which produces extremely effective texturization. Very substantial overfeed of the yarn going into the texturizing chamber is required.

SUMMARY OF THE INVENTION

The present invention utilizes a yarn treatment chamber in the form of a central bore through a small block of metal or plastic into which one or more yarns are introduced. The upstream end of the bore is substantially as large as the downstream end and preferably the bore has a uniform cross section. An air jet enters the bore through an air inlet passage more or less centrally at substantially right angles to the bore and the air leaves the bore at both open ends. Thus, with respect to the yarn travel, air streams are formed in both the cocurrent and countercurrent directions. The axis of the air inlet passage goes through or close to the center of the central bore. As a result, the incoming air jet strikes the upper wall of the central bore at a point opposite to the point of air introduction and the air jet splits to form two vortices in the upper portion of the central bore. It is in the area of these vortices that most of the desired entanglement occurs. The various flows of air in the central bore or chamber, particularly the countercurrent flow, contribute to the rapid rise of the yarns to the top of the turbulent air stream in the area of the vortices. It is impossible to eliminate completely any leakage of air back through the yarn inlet. In the present invention this is undesirable and is minimized to as great an extent as possible since this air leakage creates a force which acts against the forces which hold the yarn at the top of the turbulent air stream. The fact that there is free flow of air from both ends of the bore greatly reduces leakage back through the yarn inlet.

An important feature of the present invention is the angled introduction of the yarn or yarns into the bore at a point upstream from the air jet in the area of countercurrent air flow. The point of yarn introduction and the point of air jet introduction are on the same side of the bore which for the purposes of this description shall be designated as the bottom of the bore even though it is possible to orient the apparatus in different positions. Both the angled introduction of yarn and the countercurrent air flow urge the yarn toward the top of the bore and hold the yarn in the upper portion of the bore in the area of formation of the air vortices. The air jet causes the yarn to oscillate from side to side in the upper portion of the bore from one air vortice to the other. This effects entanglement of the yarn filaments, and since the vortices rotate in opposite directions any false twisting is alternately in opposite directions so that the yarn product does not possess any torque. This oscillation from side to side and minimizing of any false twist is in very marked contrast to my earlier issued patents which have been referred to above and which have a very high false twist.

The angle at which the yarn is introduced, while not extremely critical, should be in a range, with respect to the axis of the bore, so that it forms an acute angle therewith and varies within the range of 30° to about 65°. Best results are obtained at or near 45°, which is sufficient so that the yarns are rapidly led to the top of the bore and, as has been stated above, primary entanglement occurs by the rapid oscillation of the yarns from side to side across the top of the moving air stream. While the optimum results are obtained near 45°, the rapidity with which the yarns are raised to the top of the bore does not fall off sufficiently within the range given so that serious degradation of the entanglement effect results. It should be noted that any significant leakage of air back through the yarn inlet reduces the rapidity with which the yarn moves to the top of the air stream. Such leakage should be kept at a minimum since the positioning of the yarn in the upper portion of the bore in the area where the air jet is introduced is important in obtaining a uniform product.

It is an advantage of the invention that lower air pressure may be used than was hitherto thought necessary. The range of pressures is preferably from 6 psig to 12 psig, although with some coarser yarns, pressures of up to 20 psig can be used. The pressure is not as critical with so-called "flat" yarns, i.e., not pretexturized, which is the preferred embodiment of the present invention, as with pretexturized yarn. If pressures in the high range, 16 to 20 psig, are used with pretexturized yarn the product is not uniform. As has been mentioned above, the exact air pressure will vary somewhat with the coarseness or fineness of the yarns but when they are pretexturized, even with coarse yarns, the air pressure should be kept below that at which non-uniform, entanglement or interlacing occurs.

Preferably also a very small degree of overfeed is used, for example from about 0.1 to about 10%. This is quite small compared with the overfeed used in the Palm patent and prevents the formation of a highly voluminous yarn having loops of individual filaments projecting from the yarn. The preferred product of the present invention is an entangled or interlaced multifilament yarn of uniform appearance which has a relatively small amount of bulking. The bulking is sufficient to significantly improve the hand of fabrics produced from the treated yarn and the absence of protruding loops greatly reduces the problems encountered in handling the yarn in fabric producing apparatuses such as knitting machines and looms. The small overfeed can be produced either by overfeeding the yarn into the treatment chamber, which for many purposes is preferred, or it can also be obtained by slower winding of the yarn after it has passed through the treatment chamber.

With the apparatus of the present invention results can be varied by using different yarns and, of course, results vary also with air pressure, feed of yarn, and the like. Very high outputs, from 125 yards per minute up to a maximum of 800 yards per minute have been obtained. In general at the highest speeds slightly higher pressure is desirable but the exact pressure is not critical.

While not critical, air orifice diameters normally run from about 3/32 to 3/64 inch. The optimum orifice size will vary somewhat with the air pressure and with the rate of yarn feed.

It is preferred to use the apparatus of the present invention to entangle so-called flat yarns, that is to say, yarns which have not been texturized before they are introduced into the treatment chamber, although, of course, as pointed out above, good results can be obtained with pretexturized yarns provided that care is used to keep the air pressures sufficiently low. Uniformity of product, which is an important feature of the present invention, is more easily obtained with yarns of the flat type. The entanglement is quite uniform in visual appearance and includes a small amount of bulking. It should be noted that the uniformity which is referred to and which is such an important practical result of using the apparatus of the present invention is a visual appearance and not a microscopic examination of the final yarn. The term "uniformity" is used throughout in this visual sense, which is the only practical criterion since it is the appearance of the yarn, and particularly fabrics made therefrom, which is of importance.

While the apparatus of the present invention and its process can be used with a single multifilament yarn, it is preferred to use a plurality of yarns, two or more yarns and in some cases as many as five to obtain a plied yarn product. The yarns need not be the same and may vary in color, dyeability or other characteristics so that a variety of visual effects and physical property combinations can be obtained. The present invention can be used to combine multifilament yarns with an elastic yarn. In such cases the products obtained may resemble somewhat products that are obtained by combining elastic yarn with multifilament yarns using conventional twisters. The air entanglers of the present invention can be very much more compact, cubical blocks of less than an inch on a side being suitable, and so in such cases the plied yarn product is obtained with a much more economical apparatus.

As has been stated above, the angled introduction of the yarn into the chamber or central bore and the countercurrent air flow encountered in the area of yarn introduction result in the yarn being rapidly moved to the top of the bore or rather the top of the air jet stream. While it is not desired to limit the operation of the present invention to any particular theory, it seems most probable that the rapid oscillation of position of the yarn along the top of the air stream is an important reason for the improved uniformity of the product which is obtained with the apparatus of the present invention. It should be realized that the air stream is quite turbulent as the air jet has been introduced nearly at right angles into the bore. This causes the yarn to oscillate across the top of the stream, being first on one side of the center of the stream and then on the other. The frequency of this oscillation is quite rapid. It seems probable that the variation from countercurrent to cocurrent flow of yarn and air as it crosses the point where the air jet is introduced may also be a factor.

It will be noted that the flow of air in both directions through the bore is quite different than that in the London apparatus or that of Palm. In the apparatus of the present invention, the upstream end of the central bore is substantially as large as the downstream end and the yarn is fed into the central bore at an intermediate point so that the upstream end of the bore is free of yarn blockage. As a result, there is a substantial flow of air countercurrent to the yarn direction. In the London patent the central bore has a stepped construction to minimize countercurrent air flow and a substantial portion of the upstream end of the bore is blocked by the incoming yarn. In the Palm patent, the upstream end of the central bore is similarly of small diameter and is substantially blocked by incoming yarn.

DESCRIPTION OF THE PREFERRED EMBODIMENT

Figure 1:
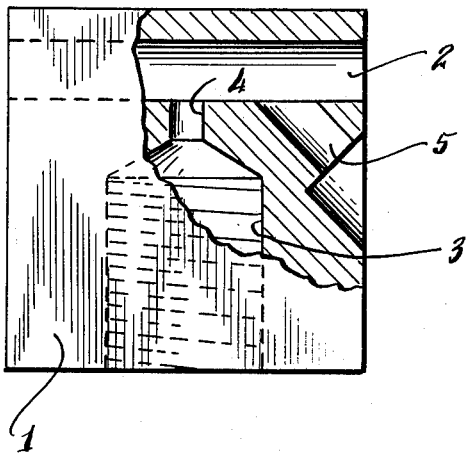
FIG. 1 is a vertical elevation, partially broken away.
Figure 2:
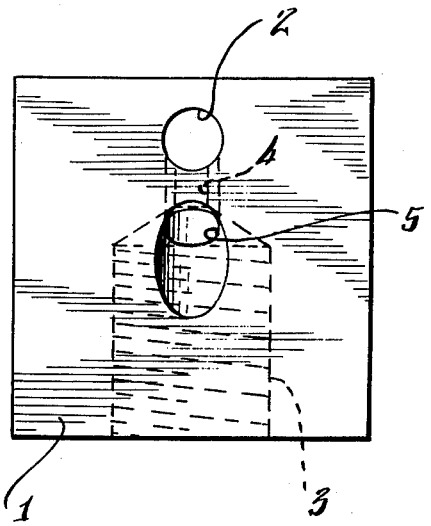
FIG. 2 is a view at right angles to FIG. 1.

In both of the figures the block in which the central and air introduction bores are made is shown at 1 with central bore 2 passing through the block with its axis preferably nearly parallel to one of the sides. Air is introduced centrally through a fitting 3 and a nozzle or air inlet passage 4 and flows out both ends of the bore 2. The introduction of one or more yarns is through an angled guide bore 5, which can be seen in FIG. 1. The yarns, as can be seen, are introduced into the bore at an angle of about 45°. The yarns then pass through the bore and out one end, and in this portion of the yarn travel the flow is first countercurrent until the yarn reaches the air jet and from there on to the exit end of the bore it is cocurrent. When the incoming air jet strikes the circular wall of central bore 2 opposite to inlet passage 4, the stream of air splits into two vortices in the upper portion of the central bore.

As has been stated above, leakage through the yarn inlet should be kept relatively low as compared to the air flowing out the ends of the bore 2. It should be noted that the yarn inlet is filled to a large extent and leaves only a very small free space through which air can leak.

As has been stated above, the yarn entangler of the present invention produces entanglement of the yarn with some degree of bulking and gives a product which is visibly uniform and has this appearance in any fabrics prepared from it. As has been described above, this is not to say that microscopically the yarn product is absolutely uniform. The practical criterion is the appearance of yarn and the appearance of fabrics prepared therefrom, and the reference to uniformity should be understood in this practical sense.

EXAMPLE 1

Two ends of 150 denier, 96-filament flat polyester yarn were fed through the air jet entangler shown in the drawings with 2.5% overfeed at an output rate of 395 yds./min. Air pressure was 12 psig. The product was visually uniform and appeared as a single yarn and not as two separate yarns. This same appearance remained when the yarn was used to prepare fabrics, both knitted and woven.

EXAMPLE 2

Two ends of 150 denier, 96-filament pretextured polyester yarn were fed through the apparatus used in Example 1 first at 150 yds./min and then a second run at 395 yds./min. Air pressure was 7 psig, considerably lower than the pressure used in Example 1 with flat yarns. An entangled, plied yarn was obtained which was visually uniform.

I claim:

1. An air jet apparatus for the production of entangled yarn comprising, in combination, a. a block, b. a bore therethrough going from side to side, c. an air introduction means substantially at right angles to the bore axis, and d. a yarn guide bore entering the texturizing bore at an acute angle to the bore.

2. An apparatus according to claim 1 in which air introduction orifice size is between 3/32 to 3/64 inch.

3. An apparatus according to claim 1 in which the angle of the yarn guide bore is sufficient to assure that the yarn rapidly moves up to the top of the bore and therefore the top of the air streams flowing through the bore.

4. An apparatus according to claim 2 in which the angle of the yarn guide bore is sufficient to assure that the yarn rapidly moves up to the top of the bore and therefore the top of the air stream flowing through the bore.

5. An apparatus according to claim 1 in which the free space in the yarn guide bore when yarns are passing therethrough is less than the cross-section of bore air outlets at either end of the texturizing bore, whereby the flow of air through both bore outlets is greater than the air flow through the yarn guide bore.

6. An apparatus according to claim 3 in which the angle of the yarn guide bore with respect to the bore axis is from 30° to 65°.

7. An apparatus according to claim 6 in which the angle of the yarn guide bore to bore axis is approximately 45°.

* * * * *